US010223852B2

(12) United States Patent
Hernandez et al.

(10) Patent No.: US 10,223,852 B2
(45) Date of Patent: Mar. 5, 2019

(54) SYSTEMS AND METHODS FOR SELECTIVE VEHICLE ACCESS

(71) Applicant: Ford Global Technologies, LLC, Dearborn, MI (US)

(72) Inventors: Alvaro Jimenez Hernandez, Miguel Hidalgo (MX); Oswaldo Perez Barrera, Texcoco (MX); Pablo Hugo Valencia Chaparro, Mexico City (MX)

(73) Assignee: Ford Global Technologies, LLC, Dearborn, MI (US)

( * ) Notice: Subject to any disclaimer, the term of this patent is extended or adjusted under 35 U.S.C. 154(b) by 290 days.

(21) Appl. No.: 15/347,329

(22) Filed: Nov. 9, 2016

(65) Prior Publication Data

US 2018/0130274 A1 May 10, 2018

(51) Int. Cl.
*G07C 9/00* (2006.01)

(52) U.S. Cl.
CPC ..... *G07C 9/00309* (2013.01); *G07C 9/00571* (2013.01); *G07C 2009/00492* (2013.01); *G07C 2009/00769* (2013.01); *G07C 2009/00793* (2013.01); *G07C 2009/00984* (2013.01)

(58) Field of Classification Search
CPC ..... G07C 9/00309; G07C 9/00571; G07C 2009/00793; B60R 25/24; B60R 25/241
See application file for complete search history.

(56) References Cited

U.S. PATENT DOCUMENTS 8,880,291 B2 11/2014 Hampiholi
8,933,778 B2 1/2015 Birkel et al.
2005/0242923 A1* 11/2005 Pearson ..... G07C 9/00309 340/5.62
2007/0229219 A1* 10/2007 Nakashima ..... B60R 25/04 340/5.61
2013/0082820 A1* 4/2013 Tieman ..... G07C 9/00309 340/5.61
2014/0176301 A1 6/2014 Fernandez Banares et al.
2014/0223185 A1* 8/2014 Bender ..... G06F 21/42 713/176
2014/0277837 A1 9/2014 Hatton
2015/0005984 A1 1/2015 De Los Santos
2015/0109099 A1* 4/2015 Birkel ..... B60R 25/24 340/5.6

(Continued)

FOREIGN PATENT DOCUMENTS

CN 103729924 A 4/2014
CN 105015489 A 11/2015

(Continued)

OTHER PUBLICATIONS

Search Report dated Apr. 27, 2018 for GB Patent Application No. GB 1718181.9 (3 pages).

*Primary Examiner* — Nabil H Syed

(74) *Attorney, Agent, or Firm* — James P. Muraff; Neal, Gerber & Eisenberg LLP

(57) ABSTRACT

A vehicle includes: motor(s), door lock(s), processor(s) configured to: attempt a direct link with a mobile device based on receiving a key fob command; attempt an indirect link with the mobile device based on failing to establish the direct link; accept and implement the command upon establishing the direct or indirect link; reject the command upon failing to establish the direct and indirect link.

16 Claims, 8 Drawing Sheets

(56) References Cited

U.S. PATENT DOCUMENTS

| | | | | |
|---|---|---|---|---|
| 2015/0120151 | A1* | 4/2015 | Akay | B60R 25/24 701/49 |
| 2015/0145648 | A1 | 5/2015 | Winkelman | |
| 2015/0287257 | A1 | 10/2015 | Thompson | |

FOREIGN PATENT DOCUMENTS

| | | | |
|---|---|---|---|
| DE | 102012022786 | A1 | 5/2014 |
| EP | 3297874 | A1 | 3/2018 |
| WO | WO 2015103206 | A2 | 7/2015 |

* cited by examiner

FIG. 7

702

| First Prestored Verification List | |
|---|---|
| Command 401b | Verification Required? |
| Lock | No |
| Unlock | Yes |
| Panic | No |
| Start | Yes |
| Open Trunk | Yes |

704

| Second Prestored Verification List | |
|---|---|
| Command 401b | Verification Required? |
| Lock | No |
| Unlock | No |
| Panic | No |
| Start | Yes |
| Open Trunk | No |

Prior Art

SYSTEMS AND METHODS FOR SELECTIVE VEHICLE ACCESS

TECHNICAL FIELD

This disclosure relates to communication between a vehicle, a key fob, and a mobile device.

BACKGROUND

Some vehicles are paired with key fobs. The key fobs are configured to transmit encrypted commands (e.g., lock, unlock, start) to the vehicles. Recently, however, thieves (also known as roll jammers) have developed a roll jamming attack to unlock vehicles. As described below with reference to FIG. 8, the roll jamming attack generally involves the thief or roll jammer intercepting and storing a valid unlock command. The thief or roll jammer subsequently transmits the valid unlock command at a later time.

As shown in FIG. 8, a known key fob 10 is configured to communicate with a known vehicle 20. The communication may cause the vehicle 20 to unlock. Key fob 10 appends a greater rolling code to each wireless message. Vehicle 20 stores a rolling code base. Vehicle 20 authenticates a wireless message when the rolling code of the wireless message is greater than the rolling code base. Upon accepting a wireless message, vehicle 20 updates the rolling code base to match the rolling code in the wireless message.

For example, imagine that the rolling code base of vehicle 20 is ten. A user presses an unlock button on the key fob 10. The key fob 10 appends a rolling code of eleven to the message. The message, however does not arrive at vehicle 20 (e.g., the key fob 10 is too far from vehicle 20 and the message attenuates). The user notices that the vehicle has not unlocked presses the unlock button on the key fob 10 for a second time. The key fob 10 now appends a rolling code of twelve to the message. The vehicle receives the message and compares the rolling code of the message (twelve) to the rolling code base (ten). The vehicle unlocks and updates the rolling code base from ten to twelve.

FIG. 8 is a schematic of a roll jammer (also called "rolljam") attack. The roll jammer attack is designed to give an unauthorized third party, the roll jammer 30, access to the vehicle 20 by storing and then re-transmitting a valid wireless signal with a valid rolling code.

Key fob 10 transmits a valid wireless message 451 (i.e., a message with a rolling code greater than the rolling code base of the vehicle 20). The roller jammer 30 intercepts the wireless message 451, records the wireless message 451, and jams the wireless message with a first signal jam 457*a* so that the vehicle 20 does not receive the wireless message 451.

The user notices that the vehicle 20 has not performed the command 401*b* associated with the wireless message 451. The user causes the key fob 10 to generate a second wireless message 452. Again, the roller jammer 30 intercepts the second wireless message 452, records the second wireless message 452, and jams the second wireless message with a second signal jam 457*b* so that the vehicle 20 does not receive the second wireless message 452.

Shortly thereafter, the roll jammer 30 transmits the stored first wireless message 451 to the vehicle 20. Since the first wireless message 451 is still valid (i.e., includes a valid rolling code), the vehicle 20 authenticates the message at block 453 and performs the command associated with the message at block 454. This action could be unlocking the vehicle doors. The user incorrectly assumes that the second wireless message 452 transmitted from the key fob 203 caused the vehicle to perform the command 401*b*.

The roll jammer 30 now possesses a copy of the second wireless message 452. The second wireless message 452 is valid because it includes a rolling code 401*c* greater than the rolling code 401*c* of the first wireless message 451. At a later time (e.g., a few hours later), the roll jammer 30 transmits the second wireless message 452 to the vehicle 20. The vehicle 20 authenticates the second wireless message 452 at block 455 and performs the command 401*b* associated with the second wireless message, such as unlocking the vehicle doors at block 456.

A solution is needed to defeat or impair the rolljam attack.

SUMMARY

Various disclosed embodiments enable a user to defeat or impair a rolljam attack by requiring a supplemental authentication (also called a verification) for a received key fob command. The verification may be provided via a mobile device.

Additional advantages of the present embodiments will become apparent after reading the following detailed description. It should be appreciated that the embodiments disclosed herein are only examples and do not limit the claimed inventions. Put differently, disclosed features are not intended to limit or narrow the claims. As a result, the claimed inventions may be broader than the disclosed embodiments.

BRIEF DESCRIPTION OF THE DRAWINGS

For a better understanding of the invention, reference may be made to embodiments shown in the following drawings. The components in the drawings are not necessarily to scale and related elements may be omitted, or in some instances proportions may have been exaggerated, so as to emphasize and clearly illustrate the novel features described herein. In addition, system components can be variously arranged, as known in the art. Further, in the drawings, like reference numerals designate corresponding parts throughout the several views.

FIG. 7 shows two verification lists.

DETAILED DESCRIPTION OF EXAMPLE EMBODIMENTS

Figure 1:
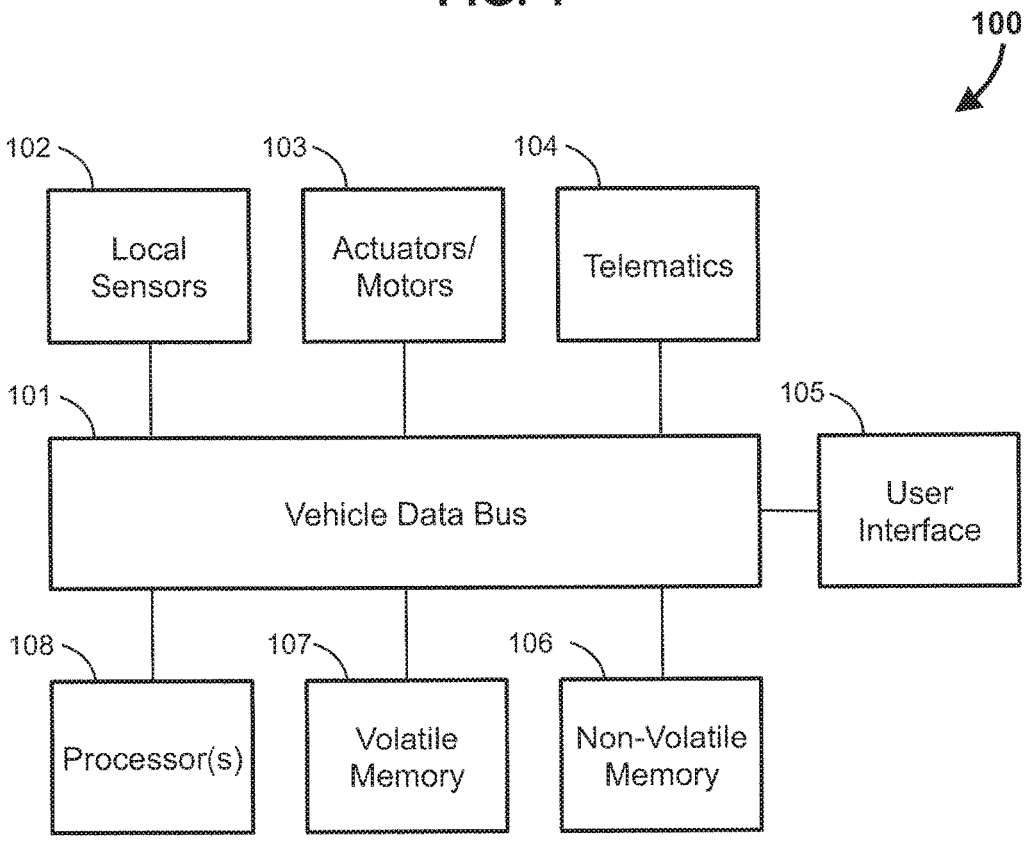
FIG. 1 is a block diagram of a computing system.

While the invention may be embodied in various forms, there are shown in the drawings, and will hereinafter be described, some exemplary and non-limiting embodiments, with the understanding that the present disclosure is to be considered an exemplification of the invention and is not intended to limit the invention to the specific embodiments illustrated.

In this application, the use of the disjunctive is intended to include the conjunctive. The use of definite or indefinite articles is not intended to indicate cardinality. In particular, a reference to "the" object or "a" and "an" object is intended to denote also one of a possible plurality of such objects. Further, the conjunction "or" may be used to convey features that are simultaneously present, as one option, and mutually exclusive alternatives as another option. In other words, the conjunction "or" should be understood to include "and/or" as one option and "either/or" as another option.

Example Computing System and Example Host Vehicle

FIG. 1 shows a computing system 100 of host vehicle 200. Host vehicle 200 is connected, meaning that host vehicle 200 is configured to (a) receive wireless data from external entities (e.g., infrastructure, servers, other connected vehicles) and (b) transmit wireless data to external entities. Host vehicle 200 may be autonomous, semi-autonomous, or manual. Host vehicle 200 includes a motor, a battery, at least one wheel driven by the motor, and a steering system configured to turn the at least one wheel about an axis. Host vehicle 200 may be fossil fuel powered (e.g., diesel, gasoline, natural gas), hybrid-electric, fully electric, fuel cell powered, etc.

Vehicles are described, for example, in U.S. patent application Ser. No. 14/991,496 to Miller et al. ("Miller"), U.S. Pat. No. 8,180,547 to Prasad et al. ("Prasad"), U.S. patent application Ser. No. 15/186,850 to Lavoie et. al. ("Lavoie"), and U.S. patent application Ser. No. 14/972,761 to Hu et al. ("Hu"), all of which are hereby incorporated by reference in their entireties. Host vehicle 200 may include any of the features described in Miller, Prasad, Lavoie, and Hu.

Computing system 100 resides in host vehicle 200. Computing system 100, among other things, enables automatic control of mechanical systems within host vehicle 200 and facilitates communication between host vehicle 200 and external entities. Computing system 100 includes a data bus 101, one or more processors 108, volatile memory 107, non-volatile memory 106, user interfaces 105, a telematics unit 104, actuators and motors 103, and local sensors 102.

Data bus 101 traffics electronic signals or data between the electronic components. Processor 108 performs operations on electronic signals or data to produce modified electronic signals or data. Volatile memory 107 stores data for near-immediate recall by processor 108. Non-volatile memory 106 stores data for recall to the volatile memory 107 and/or the processor 108. Non-volatile memory 106 includes a range of non-volatile memories including hard drives, SSDs, DVDs, Blu-Rays, etc. User interface 105 includes displays, touchscreen displays, keyboards, buttons, and other devices that enable user interaction with the computing system. Telematics unit 104 enables both wired and wireless communication with external entities via Bluetooth, cellular data (e.g., 3G, LTE), USB, etc.

Actuators/motors 103 produce tangible results. Examples of actuators/motors 103 include fuel injectors, windshield wipers, brake light circuits, transmissions, airbags, motors mounted to sensors (e.g., a motor configured to swivel a local sensor 102), engines, motors, power train motors, door locks, steering, etc. Local sensors 102 transmit digital readings or measurements to processors 108. Examples of local sensors 102 include temperature sensors, rotation sensors, seatbelt sensors, speed sensors, cameras, lidar sensors, radar sensors, infrared sensors, ultrasonic sensors, clocks, moisture sensors, rain sensors, light sensors, etc. It should be appreciated that any of the various electronic components of FIG. 1 may include separate or dedicated processors and memory. Further detail of the structure and operations of computing system 100 is described, for example, in Miller, Prasad, Lavoie, and Hu.

Figure 2:
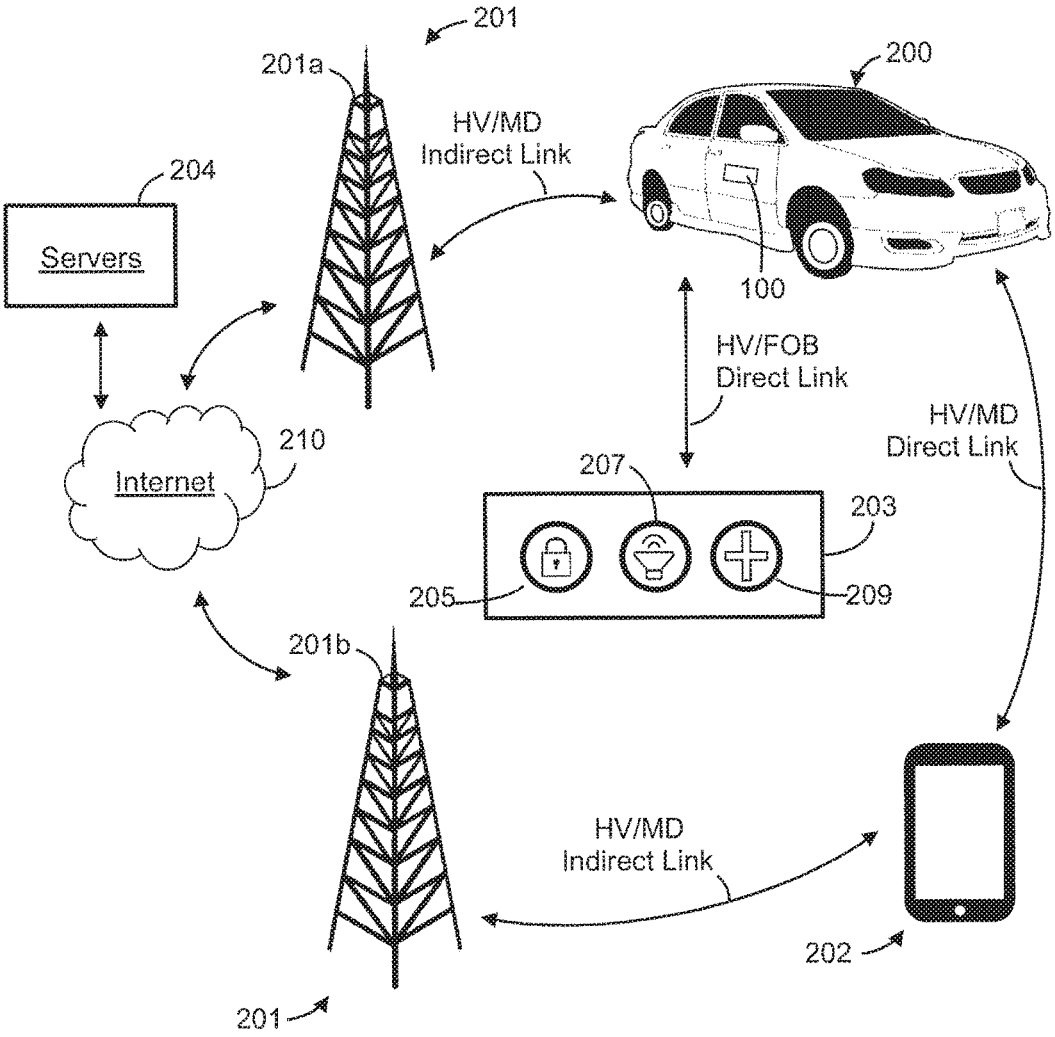
FIG. 2 shows communication links between a host vehicle, which includes the computing system, a key fob, a mobile device, antennas, the Internet, and servers.

FIG. 2 illustrates host vehicle 200, which includes computing system 100. With respect to host vehicle 200, some of the local sensors 102 are mounted on an exterior of host vehicle 200 (others are located inside the vehicle 200). One or more local sensors 102 are configured to detect objects surrounding host vehicle 200 (e.g., 360 degrees about host vehicle 200).

As previously discussed, local sensors 102 may be ultrasonic sensors, lidar sensors, radar sensors, infrared sensors, cameras, microphones, and any combination thereof, etc. Host vehicle 200 includes a plurality of other local sensors 102 located in the vehicle interior or on the vehicle exterior. Local sensors 102 may include any or all of the sensors disclosed in Miller, Prasad, Lavoie, and Hu. According to various embodiments, host vehicle 200 includes some or all of the features of vehicle 100*a* of Prasad. According to various embodiments, computing system 100 includes some or all of the features of VCCS 102 of FIG. 2 of Prasad.

The term "loaded vehicle," when used in the claims, is hereby defined to mean: "a vehicle including: a motor, a plurality of wheels, a power source, and a steering system; wherein the motor transmits torque to at least one of the plurality of wheels, thereby driving the at least one of the plurality of wheels; wherein the power source supplies energy to the motor; and wherein the steering system is configured to steer at least one of the plurality of wheels." Host vehicle 200 may be a loaded vehicle.

The term "equipped electric vehicle," when used in the claims, is hereby defined to mean "a vehicle including: a battery, a plurality of wheels, a motor, a steering system; wherein the motor transmits torque to at least one of the plurality of wheels, thereby driving the at least one of the plurality of wheels; wherein the battery is rechargeable and is configured to supply electric energy to the motor, thereby driving the motor; and wherein the steering system is configured to steer at least one of the plurality of wheels." Host vehicle 200 may be an equipped electric vehicle.

Example Communication Network

FIG. 2 shows a plurality of antennas 201 (including a first antenna 201*a* and a second antenna 201*b*), a mobile device 202, a key fob 203, one or more servers 204, and the Internet 210. Antenna 201 represents infrastructure enabling connected devices to access the Internet.

Mobile device 202 may include any or all of the features described with reference to FIG. 1. Mobile device 202 may be any suitable connected device such as a tablet, a smartphone, a laptop, a PC, etc. Mobile device 202 and host vehicle 200 are configured to be inoperative wireless communication via (a) an indirect wireless link and (b) a direct wireless link.

With respect to the indirect wireless link, connected devices (e.g., host vehicle 200 and mobile device 202) are configured to communicate with antennas 201 via wireless technology (e.g., a cellular connection such as 2G, 3G, 4G, LTE, a WiFi connection, a Bluetooth connection, etc). Antennas 201 communicate with each other over the Internet 210. By virtue of the indirect link, mobile device 202 and host vehicle 200 are thus configured to communicate over any distance (e.g., across the entire United States) through one or more intermediaries (e.g., antennas 201, Internet 210).

With respect to the direct wireless link, mobile device 202 and host vehicle 200 are configured to directly communicate, without intermediaries, via technology such as Bluetooth or NFC. Because the direct link does not include intermediaries, the direct link is geographically limited. More specifically, the direct link is only available when mobile device 202 is within a certain wireless signal transmission distance of host vehicle 200.

Key fob 203 and host vehicle 200 are paired and are configured to communicate via a direct link (e.g., radio communication, Bluetooth, NFC). As described in U.S. Pat. No. 8,594,616 to Gusikhin, which is hereby incorporated by reference in its entirety, key fob 203 is equipped with a plurality of buttons. For example, an unlock/lock button 205 instruct host vehicle 200 to lock or unlock the doors. A panic button 207 instructs host vehicle 200 to activate the horn and headlights. A start button 209 instructs host vehicle 200 to activate for driving. Key fob 203 and host vehicle 200 may communicate via the systems and methods disclosed in Gusikhin. Key fob 203 and/or host vehicle 200 share the structure disclosed in U.S. Pat. No. 8,594,616.

Figure 3:
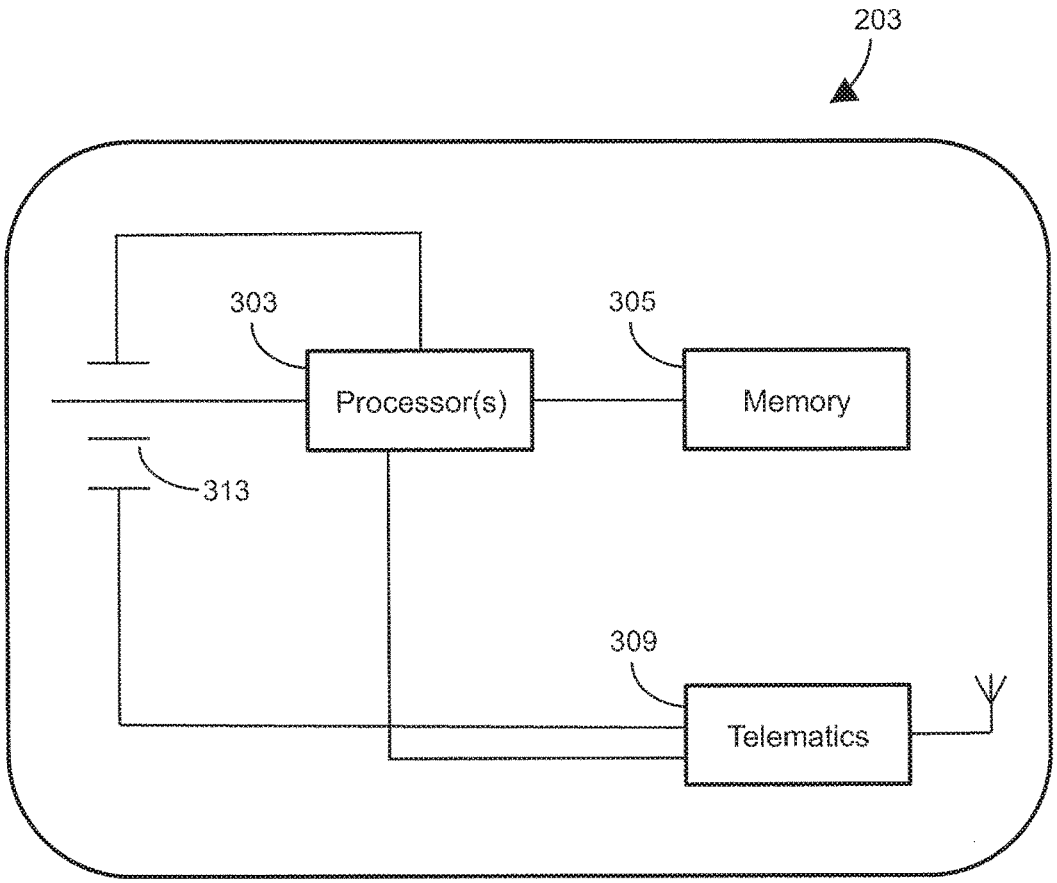
FIG. 3 is a block diagram of certain electronic components of the key fob.

FIG. 3 shows exemplary electronic components the key fob 203. The electronic components include one or more processors 303, memory 305, telematics 309, and a battery 313. Telematics 309 may include transceivers and transponders. As stated above, key fob 203 may communicate with host vehicle 200 via any known direct wireless communication technology. According to some embodiments, key fob 203 may communicate with host vehicle 200 via an indirect link (e.g., via the antennas 201 and the Internet 210).

Figure 4:
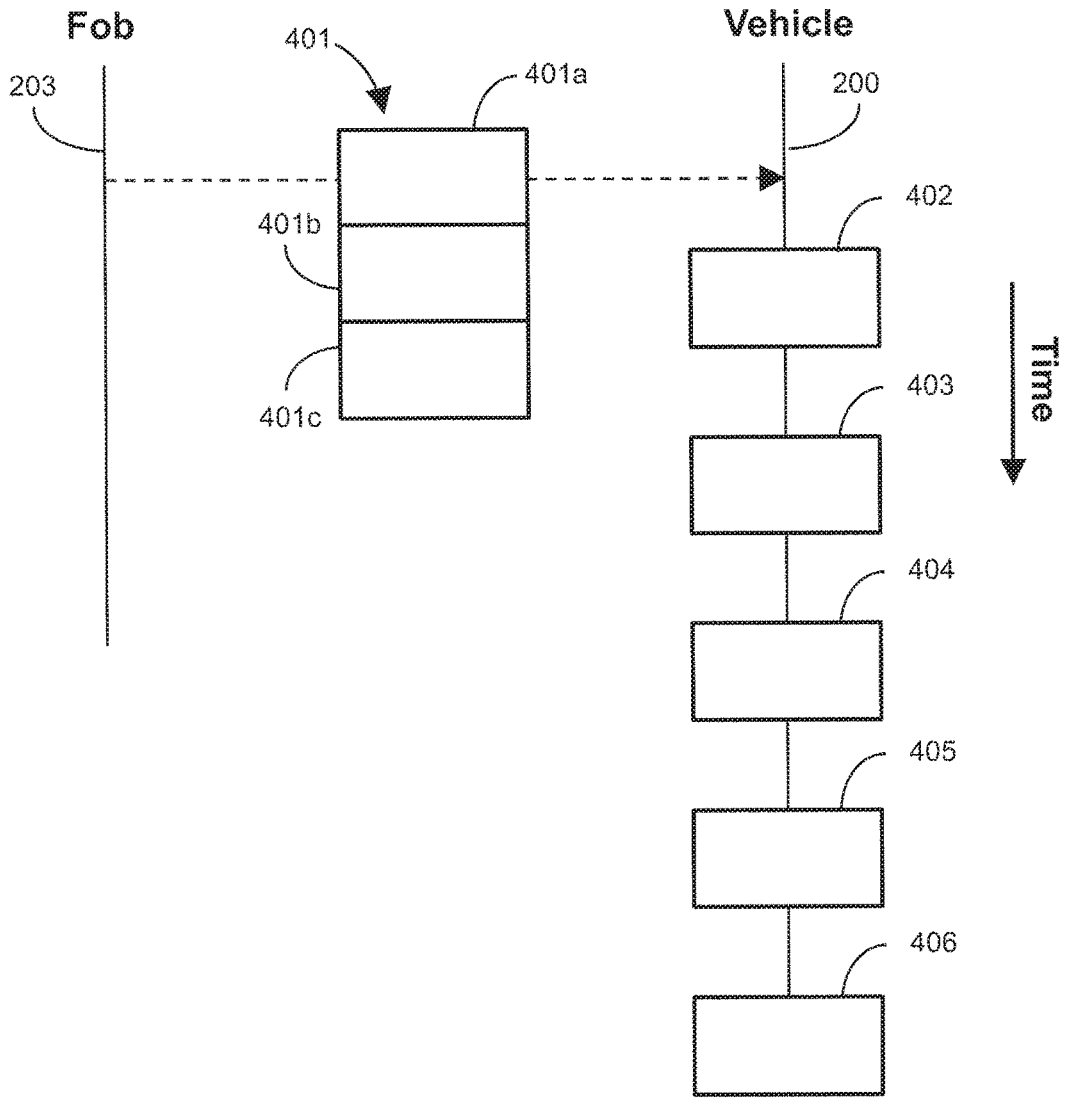
FIG. 4 is a block diagram of a method of implementing a key fob command.

Overview of an Example Method of Authenticating, Verifying, and Implementing a Key Fob Command Host vehicle 200 and key fob 203 may be configured to apply rolling code technology. FIG. 4 is a block diagram 400 of communication between a key fob 203 and host vehicle 200. When a user generates a command at the key fob 203 (e.g., by pressing lock/unlock button 205), the key fob 203 generates a short-range radio wireless signal 401 for the vehicle 20. The wireless signal 401 includes blocks of information 401*a*, 401*b*, and 401*c*. Transmitter ID 401*a* uniquely identifies the key fob 203. Desired vehicle function 401*b* is a command for the vehicle generated by the key fob 203, such as a lock command, an unlock command, or vehicle start command. Rolling code 401*c* is a security mechanism that enables host vehicle 200 to authenticate the wireless message 401. Transmitter ID 401*a*, desired vehicle function 401*b*, and rolling code 401*c* are known in the art.

The rolling code 401*c* is a number generated by the key fob 203 and appended to the wireless signal 401. Host vehicle 200 stores a rolling code base. Every time the user generates a command at the key fob 10, the key fob 203 generates a new rolling code 401*c* with a value greater than every previous rolling code and appends the new rolling code 401*c* to the wireless signal 401.

For example, the first time a user generates a command at the key fob 10, the rolling code 401*c* may be 100. The second time the user generates a command at the key fob, the rolling code 401*c* may increment to 101. When host vehicle 200 receives a valid wireless signal 401, host vehicle 200 updates the rolling code base to match the rolling code 401*c* transmitted by the key fob 203.

Host vehicle 200 is configured to only authenticate wireless signals 401 with a rolling code 401*c* greater than the rolling code base stored in the vehicle. For example, if the current rolling code base stored in host vehicle 200 was 800, then host vehicle 200 would only accept wireless transmissions 401 from the key fob 203 having a rolling code 401*c* of 801 or more. Wireless transmissions 401 from the key fob 203 to host vehicle 200 are encrypted so that it is impractical or substantially impossible for a third party to generate a wireless signal 401 having a particular rolling code (e.g., a rolling code of 1,000,000).

At block 402, host vehicle 200 processes the wireless signal 401. More specifically, host vehicle 200 compares the unique identifier 401*a* of the key fob 10 to a list of authorized unique key fob identifiers, stores the desired command 401*b*, and authenticates the key fob via the rolling code 401*c*.

At block 403, host vehicle 200 determines whether the command requires a supplemental authentication (also called a verification). More specifically, host vehicle 200 compares the desired command 401*b* to a prestored verification list. Some of the commands do not require verification (e.g., a lock command or a panic command). When this is the case, host vehicle 200 skips to block 405. Other commands do require verification (e.g., an unlock command or a remote start command). When this is the case, host vehicle 200 proceeds to block 404.

At block 404, host vehicle 200 determines an active mode (discussed below with reference to FIG. 6). Some modes cause host vehicle 200 to (a) reject the desired command 401*b* or (b) implement the desired command 401*b* and arm. Other modes cause host vehicle 200 to accept the command and proceed to block 405. At block 405, host vehicle 200 performs the desired command 401*b* (e.g., unlocking the doors, locking the doors, remote starting, etc.). The desired command 401*b* may be performed by sending an instruction to actuators/motors 103 (e.g., door locks, motors). Block 406, as with all operations disclosed herein, is optional, and discussed below.

Example Method of Arming the Vehicle

According to some embodiments, an unverified command is rejected by host vehicle 200. According to other embodiments, an unverified command is implemented (if the command is anything except a start command) but causes host vehicle 200 to arm. According to some embodiments, unverified start commands are always rejected.

When a door is opened and host vehicle 200 is armed, a first sound pattern is played, a prompt is shown on a touchscreen display, and one or more interior cameras begin to record. The prompt asks the user to enter a password.

If the user fails to enter the password within a predetermined period of time, host vehicle 200 plays a second sound pattern (e.g., an alarm), sends a warning to mobile device 202 via an indirect link (discussed below), saves the recorded video, and uploads the saved video to server 204. If the user enters the password within the predetermined period of time, host vehicle 200 stops playing the first sound pattern, deletes the video, and accepts all commands from the key fob 203 for a predetermined period of time.

It should be appreciated that a subsequent verified command may cause host vehicle 200 to disarm. It should be appreciated that a certain response to the warning, from the mobile device 202, may cause host vehicle 200 to disarm.

Example Method of Verifying a Key Fob Command

Figure 6:
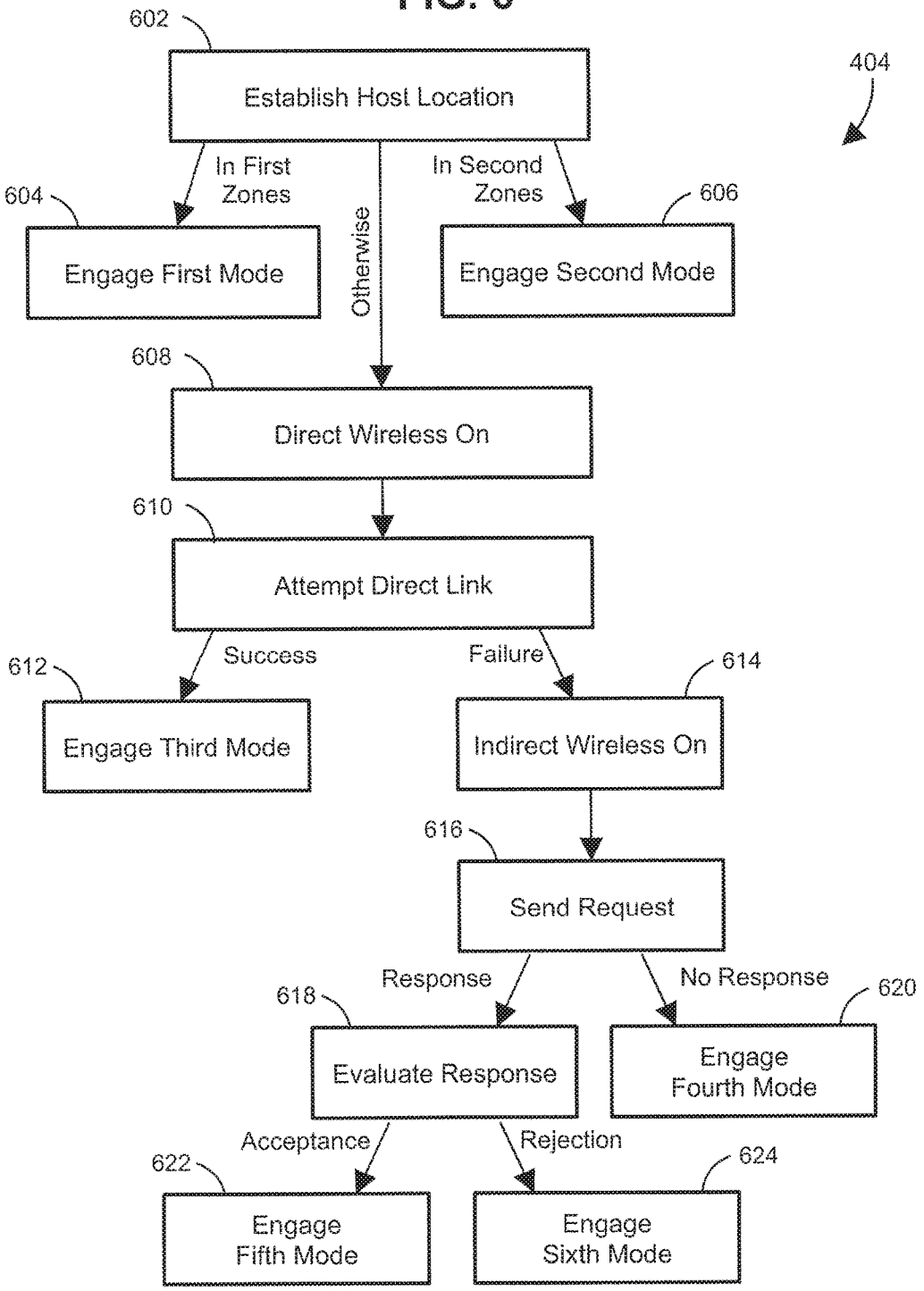
FIG. 6 is a block diagram of a method of verifying the key fob command.
Figure 8:
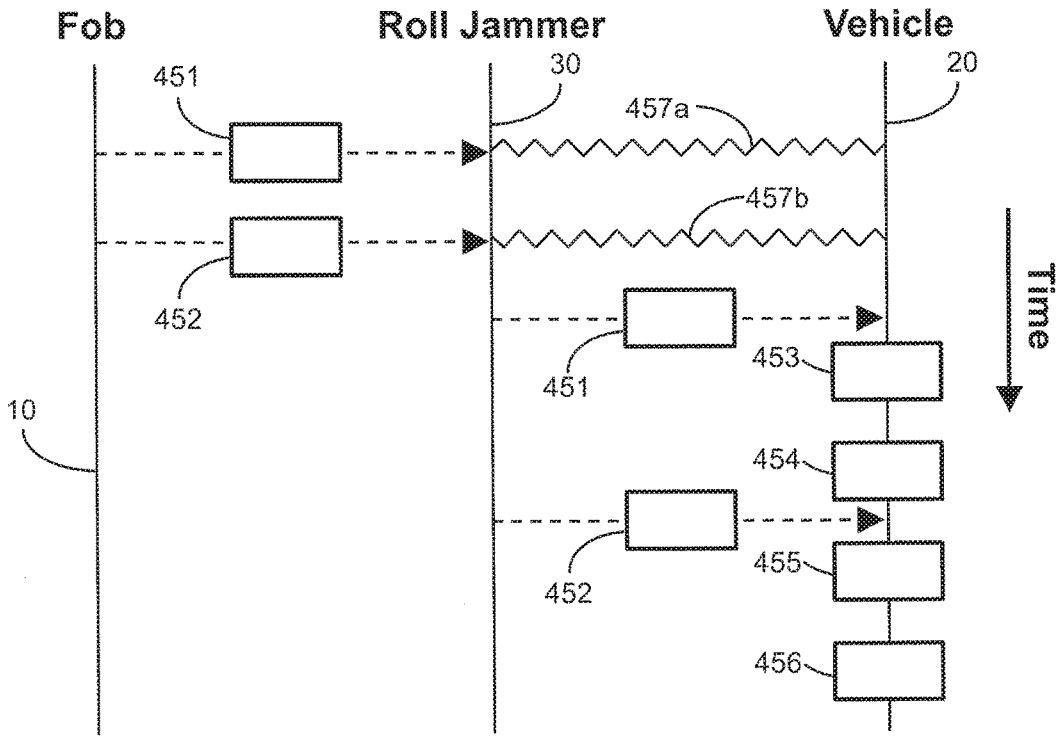
FIG. 8 is a prior art block diagram of a rolljam attack.

FIG. 6 shows operations that may performed at block 404. Host vehicle 200 performs these operations to determine whether a desired command 401*b*, which has been authenticated at block 402, and determined to require verification at block 403, is verified or non-verified.

At block 602 a location of host vehicle 200 is determined. The location is compared with prestored first geographical zones and second geographical zones. The first and second geographical zones may be updatable via the mobile device 202. If host vehicle 200 is in one of the first geographical zones, then a first mode is engaged at block 604. If host vehicle 200 is in one of the second geographical zones, then a second mode is engaged at block 606.

The first geographical zones may represent safe zones, where a user believes that host vehicle 200 is unlikely to encounter a thief (e.g., a roll jammer). Thus, the first mode may cause host vehicle 200 to verify the command 401*b*. The second geographical zones may represent unsafe zones, where a user believes that host vehicle 200 is highly likely to encounter a thief (e.g., a different country or continent). Thus, the second mode may cause host vehicle 200 to not verify the command (e.g., (a) reject the command 401*b* and issue a warning to the mobile device 202 or (b) implement the command 401*b*, but arm host vehicle 200 and issue the warning). The warning may be transmitted via an indirect wireless link (discussed below) and thus may involve host vehicle 200 transmitting an instruction to server 204, which forwards the warning to the mobile device 202. Thus, a response to the warning may flow from the mobile device, to the server 204, to host vehicle 200.

If host vehicle 200 is neither of the first and second geographical zones, then telematics 104 is controlled to enable the direct wireless link between host vehicle 200 and mobile device 202 at block 608. As discussed above, the direct wireless link may be Bluetooth and thus, at block 608, host vehicle 200 may (a) turn the Bluetooth transmitter/receiver on or (b) confirm that the Bluetooth transmitter/receiver is already on.

At block 610, host vehicle 200 (*a*) attempts to initiate the direct wireless link with mobile device 202 or (b) determines whether a current direct wireless link between the mobile device 202 and host vehicle 200 is present. It should be appreciated that block 610 requires a link with a specific and prestored mobile device 202 (i.e., a mobile device 202 having a certain unique ID, such as a MAC address). If the direct wireless link is present, then a third mode is engaged at block 612. The third mode may cause host vehicle 200 to verify the command 401*b*.

If, after waiting a predetermined amount of time, the direct wireless link is not detected to be present, then telematics 104 is controlled to enable the indirect wireless link between host vehicle 200 antenna 201*a* at block 614. As discussed above, the indirect wireless link may be an internet connection and thus, at block 614, host vehicle 200 may (a) turn a cellular transmitter/receiver on or (b) confirm that the cellular transmitter/receiver is already on.

At block 616, host vehicle 200 attempts to contact the user via the indirect wireless link. The contact may be in the form of a text message to one or more prestored cellular numbers, an email to one or more prestored email addresses, and/or a notification to a prestored app account associated with the user. It should be appreciated that host vehicle 200 may send an instruction to a server 204 to forward the request. For example, host vehicle 200 may instruct server 204 to send an email to the prestored email address.

According to some embodiments, the request of block 616, in contrast to the request of block 610, is not directed to any specific, unique, or prestored mobile device. Instead, the request of block 616 is sent to an account associated with the user (e.g., the cellular number, the email address, the app account). As such, the user may respond from any mobile device 202.

At block 616, host vehicle 200 determines whether a response has been received. According to some embodiments, the response may be a message from the server 204, as opposed to a response sent directly from the mobile device 202. For example, the user may respond with an email. The server 204 may determine that the email has been received, and then send the response to host vehicle 200 confirming receipt of the email.

If, after waiting a predetermined amount of time, no response has been received, a fourth mode is engaged at block 620. The fourth mode may cause host vehicle 200 to not verify the command 401*b*. If a response is received within the predetermined period of time, then the response is evaluated at block 618. As stated above, the response may be a message from external server 204, which may automatically generate such a response in reply to a message received from the mobile device 202. The response may include an accept command (pass) or may include a reject command (fail). It should thus be appreciated that the server 204 is configured to translate the message from the mobile device 202 into an accept command or a reject command.

If the response includes an accept command, host vehicle 200 engages a fifth mode at block 622. If the response includes a reject command, host vehicle 200 engages a sixth mode at block 624. It should be appreciated that if the response includes a reject command, host vehicle 200 may determine that that an indirect rejection link has been established with mobile device 202. It should be appreciated that if the response includes an accept command, host vehicle 200 may determine that that an indirect acceptance link has been established with mobile device 202.

The fifth mode may cause host vehicle 200 to verify and thus accept command 401*b* of the key fob 203. The sixth mode may cause host vehicle 200 to not verify the command 401*b*. According to some embodiments, the sixth mode may cause host vehicle 200 to reject the command and arm, but never implement the command. Thus, the sixth mode may be different from the other non-verification modes, which may enable host vehicle 200 to implement the command (along with arming).

As stated above, if the operations of FIG. 6 result in a verification, then host vehicle 200 implements command 401*b* of key fob 203 at block 405. If the operations of FIG. 6 result in a non-verification, then host vehicle 200 rejects the command 401*b* (according to some embodiments) or implements the command and arms (according to other embodiments).

Example Method of Selecting a Verification List

As previously discussed, block 403 includes referencing a prestored verification list. FIG. 7 shows two different prestored verification lists 702 and 704. As shown in FIG. 7, each entry of list 702 pairs one command 401*b* with one verification description. Some commands 401*b* do not require verification. Other commands do require verification.

Figure 5:
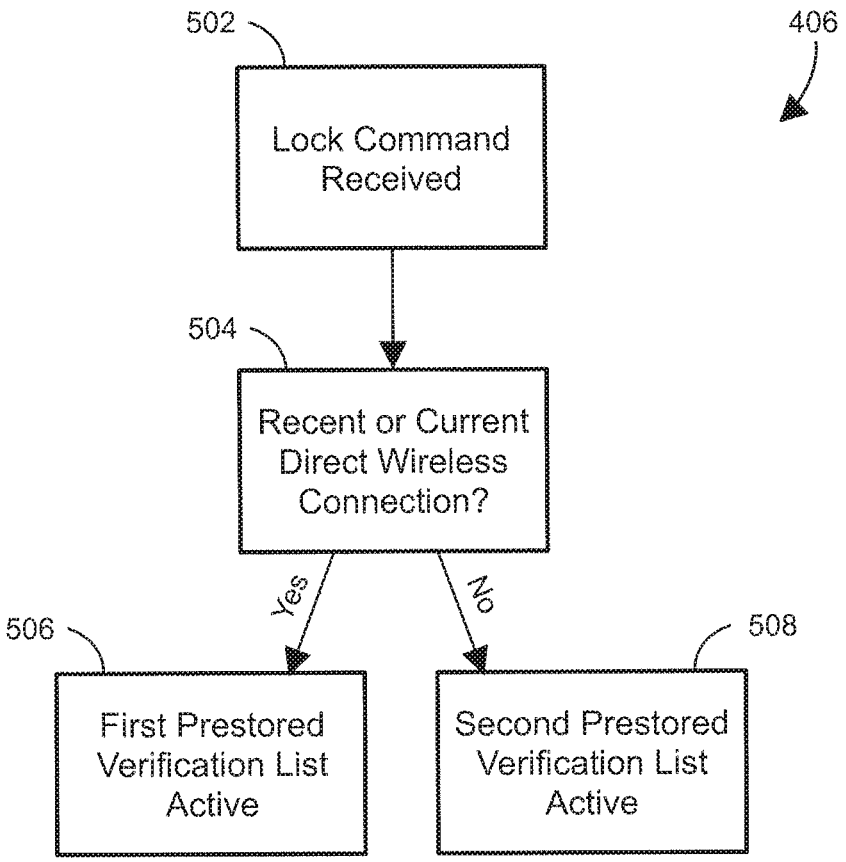
FIG. 5 is a block diagram of a method of selecting an active verification list. The key fob command is compared to the active verification list.

FIG. 5 shows exemplary operations that determine which prestored command list 702, 704 is active. These operations may occur at block 406 of FIG. 4. At block 502, host vehicle 200 determines whether a lock command was implemented at block 405. If no lock command was implemented, then the operations of FIG. 5 end. If a lock command was received, host vehicle 200 determines whether a prestored mobile device 202 was recently, or is currently, directly linked to host vehicle 202 (e.g., via Bluetooth). Recent may mean during or after the most recent key cycle of host vehicle 200. Recent may mean a predetermined time span (e.g., the past 10 minutes).

If the prestored mobile device 202 was directly linked to host vehicle 202, then the first prestored verification list 702 is engaged. The first prestored verification list 702 will thus be referenced during a subsequent iteration of FIG. 4. If the prestored mobile device 202 was not directly linked to host vehicle 202, then the second prestored verification list 704 is engaged. The second prestored verification list 704 will thus be referenced during a subsequent iteration of FIG. 4.

As shown in FIG. 7, the first prestored verification list 702 may be more restrictive than the second prestored verification list 704. Thus, in cases where the mobile device 202 was recently directly connected, host vehicle 200 may expect the user to be carrying the mobile device 202 and thus expect the mobile device 202 to be available during subsequent iterations of the operations of FIG. 4.

According to some embodiments, host vehicle 200 automatically reverts from the second prestored verification list 704 to the first prestored verification list 702 after a predetermined period of time. According to some embodiments, host vehicle 200 only proceeds from block 504 to block 506 when the prestored mobile device 202 was directly linked and when the prestored mobile device 202 was last determined, by host vehicle 200, to have a remaining battery life above a predetermined battery life percentage. According to some embodiments, host vehicle 200 selects between the verification lists 702, 704 based on a current location of host vehicle 200. For example, when host vehicle 200 is in the first zone (see FIG. 7), the second verification list 704 be active. Otherwise, the first verification list 702 may be active.

The invention claimed is:

1. A vehicle comprising:
motor(s), door lock(s), processor(s) configured to:
attempt a direct link with a mobile device based on receiving a key fob command;
attempt an indirect link with the mobile device based on failing to establish the direct link;
accept and implement the command upon establishing the direct or indirect link;
reject the command upon failing to establish the direct and indirect link.

2. The vehicle of claim 1, wherein the processor(s) are configured to:
compare the key fob command to a prestored verification list including first entries and second entries;
accept and implement the command when the command corresponds to one of the first entries;
attempt the direct link with the mobile device when the command corresponds to one of the second entries.

3. The vehicle of claim 1, wherein the processor(s) are configured to:
attempt the direct link with a mobile device based on receiving the key fob command and based on determining that the first vehicle is outside of a first geographical zone.

4. The vehicle of claim 1, wherein the indirect link is an indirect acceptance link.

5. The vehicle of claim 1, wherein the processor(s) are configured to: only attempt to establish the indirect link after failing to establish the direct link.

6. A vehicle comprising:
motor(s), door lock(s), processor(s) configured to:
categorize a received key fob command into one of a first category or a second category based on a verification list;
attempt a direct link with a mobile device when the command is in the first category;
attempt an indirect link with the mobile device upon failing to establish the direct link;
accept and implement the command when either of the following is true: (a) the indirect link or the direct link is established and (b) when the command is the second category.

7. The vehicle of claim 6, wherein the verification list is an active list of a plurality of possible lists.

8. The vehicle of claim 7, wherein the processor(s) are configured to: select one of the plurality of possible lists as the active list based on a recent wireless connection with the mobile device.

9. The vehicle of claim 8, wherein the processor(s) are configured to: select one of the plurality of possible lists as the active list based on a battery level of the mobile device.

10. The vehicle of claim 9, wherein the processor(s) are configured to: select one of the plurality of possible lists as the active list based on a current time.

11. The vehicle of claim 6, wherein processor(s) are configured to attempt to establish the indirect link by instructing a remote server to send an electronic message to a predetermined account.

12. The vehicle of claim 11, wherein the processor(s) are configured to establish the direct link upon receiving a response from the remote server, the response including an indication that the identified account replied to the electronic message with an acceptance.

13. A method of controlling a vehicle, the vehicle comprising motor(s), door lock(s), processor(s), the method comprising, via the processor(s):
categorizing a received key fob command into one of a first category or a second category based on a verification list;
attempting a direct link with a mobile device when the command is in the first category;
attempting an indirect link with the mobile device upon failing to establish the direct link;
accepting and implementing the command when either of the following is true: (a) the indirect link or the direct link is established and (b) when the command is the second category.

14. The method of claim 13, wherein the verification list is an active list of a plurality of possible lists.

15. The method of claim 14, comprising selecting one of the plurality of possible lists as the active list based on a recent wireless connection with the mobile device.

16. The method of claim 13, comprising attempting to establish the indirect link by instructing a remote server to send an electronic message to a predetermined account.

* * * * *